US009592926B2

(12) United States Patent
Dammeyer

(10) Patent No.: US 9,592,926 B2
(45) Date of Patent: Mar. 14, 2017

(54) CARDBOARD PACKAGING, AND A PACKAGING BLANK FOR PRODUCING A CARDBOARD PACKAGING OF THIS TYPE

(71) Applicant: Nordpack GmbH, Isernhagen (DE)

(72) Inventor: Mark Dammeyer, Hannover (DE)

(73) Assignee: NORDPACK GMBH, Isernhagen (DE)

( * ) Notice: Subject to any disclaimer, the term of this patent is extended or adjusted under 35 U.S.C. 154(b) by 0 days.

(21) Appl. No.: 14/888,458

(22) PCT Filed: Dec. 12, 2013

(86) PCT No.: PCT/DE2013/100421

§ 371 (c)(1),
(2) Date: Nov. 2, 2015

(87) PCT Pub. No.: WO2014/094735

PCT Pub. Date: Jun. 26, 2014

(65) Prior Publication Data

US 2016/0068296 A1 Mar. 10, 2016

(30) Foreign Application Priority Data

Dec. 17, 2012 (DE) ..... 20 2012 104 912 U

(51) Int. Cl.
*B65D 5/20* (2006.01)
*B65D 5/00* (2006.01)
(Continued)

(52) U.S. Cl.
CPC ..... *B65D 5/2052* (2013.01); *B65D 5/009* (2013.01); *B65D 5/029* (2013.01); *B65D 85/68* (2013.01);
(Continued)

(58) Field of Classification Search
CPC ..... B65D 5/009; B65D 5/029; B65D 5/2052; B65D 85/68; B65D 2585/6882; B65D 2585/6887
(Continued)

(56) References Cited

U.S. PATENT DOCUMENTS 2,981,407 A 4/1961 Gaulke et al.
2,984,343 A 5/1961 Van Antwerpen et al.
(Continued)

FOREIGN PATENT DOCUMENTS

DE 4100251 A1 7/1992
DE 20208522 U1 9/2002
(Continued)

*Primary Examiner* — J. Gregory Pickett
*Assistant Examiner* — Brijersh V. Patel
(74) *Attorney, Agent, or Firm* — Leydig, Voit & Mayer, Ltd.

(57) ABSTRACT

A cardboard packaging is produced from a flat cardboard blank by simple manual folds and without using tools, and is used for packing elongate objects having bent ends. The cardboard packaging has a rectangular central portion and two rectangular side portions which are symmetrically arranged on opposing sides of the central region so as to be inclined at the same angle relative to the central portion, such that a concave upper face and a convex lower face of the cardboard packaging result. The front faces of the side and central portions, and the rear faces of the side and central portions each form parallel planes, overlap regions resulting between the side portions and the central portion. The surfaces of the side portions are each connected to the surface of the central portion by two tuck-in flap connections designed as counter-tuck-in flap connections.

14 Claims, 2 Drawing Sheets

(51) Int. Cl.
*B65D 5/02* (2006.01)
*B65D 85/68* (2006.01)

(52) U.S. Cl.
CPC ..... *B65D 2585/6882* (2013.01); *B65D 2585/6887* (2013.01)

(58) Field of Classification Search
USPC ..... 206/335, 448; 229/103.2–103.3, 229/125.28–125.29, 125.32, 137–159
See application file for complete search history.

(56) References Cited

U.S. PATENT DOCUMENTS 3,780,933 A * 12/1973 Freeman ..... B65D 65/12 206/335
8,474,618 B2 * 7/2013 McDowell ..... B65D 85/48 206/448

FOREIGN PATENT DOCUMENTS

JP 06321231 A 11/1994
JP 2001192017 A 7/2001
JP 2001341737 A 12/2001
JP 2004091026 A 3/2004
JP 2007050920 A 3/2007

* cited by examiner

CARDBOARD PACKAGING, AND A PACKAGING BLANK FOR PRODUCING A CARDBOARD PACKAGING OF THIS TYPE

CROSS-REFERENCE TO RELATED APPLICATIONS

This application is a U.S. national stage application under 35 U.S.C. §371 of International Application No. PCT/DE2013/100421, filed on Dec. 12, 2013, and claims benefit to German Patent Application No. DE 20 2012 104 912.0, filed on Dec. 17, 2012. The International Application was published in German on Jun. 26, 2014, as WO 2014/094735 A1 under PCT Article 21(2).

FIELD

The invention relates to cardboard packaging produced by means of folding from a single, flat cardboard blank for packing objects in particular provided with bends or curves, comprising an in particular rectangular central portion and two in particular rectangular side portions which are arranged on opposing sides of the central portion, a respective outer surface of the side portions being arranged in a manner inclined towards the central portion so as to enclose an obtuse angle with respect to the adjacent outer surface of the central portion, and being connected to the central portion by means of a tuck-in flap connection consisting of a tuck-in flap and a perforation. The invention further relates to a flat cardboard blank for producing cardboard packaging of this kind.

BACKGROUND

Cardboard packaging of this kind, intended for packing objects which are sensitive to impacts, for example bumpers for motor vehicles, produced from a single cardboard blank provided with folding and cutting lines, is known in a number of designs and therefore belongs to the prior art simply on account of public prior use.

Cardboard packaging of this kind is characterized in particular in that said packaging approximates the curved or bent contour of the object. In comparison, simple rectangular cardboard packaging is ruled out for practical use simply for reasons of efficiency. Rather, attempts are being made to keep as small as possible the space inside the cardboard packaging which is not filled by the object in order to reduce transport costs.

In this case, the specific demands placed on the cardboard packaging and the blank thereof arise from the desired concave and convex upper face and lower face respectively, which can also be referred to as a U-shape for example. Of course, in this case the limbs are not necessarily designed so as to be parallel or axisymmetric, with the result that, depending on the purpose of use, various cardboard packaging having correspondingly different complexities are used for different shapes and sizes.

At the same time, however, simple handling of the flat cardboard blank is also required in order for it to be possible to keep the time required for assembling the cardboard packaging within reasonable limits. The same also applies to the degree of difficulty and to the additional staff and means required for assembling the cardboard packaging.

In order to bring the side portions, which form limbs which are inclined relative to the central portion, into the desired position and to correspondingly fix said side portions, the substantially rectangular side portions form, in the bent position in particular maintained by the assembler, an overlap region on the front face and on the rear face respectively. In the overlap region, the side portions are provided with corresponding tuck-in flap connections, which engage in corresponding perforations in the front face and the rear face of the central portion.

In this case, however, the unfavorable leverage ratios, due to which the tuck-in flap connections are heavily loaded even when a relatively low force acts on the upper face of the cardboard packaging, have been found to be disadvantageous. Consequently, the tuck-in flap connections break in this region.

Furthermore, it has been found to be disadvantageous that the opposing tuck-in flaps on the front face and the rear face have to be positioned simultaneously and practical handling is made more difficult thereby. The actual position on the front face and the rear face can often not be controlled or adjusted by one person alone, meaning that, in practice, an additional person is required for assembling the cardboard packaging.

DE 202 08 522 U1 relates to packaging for motor vehicle bumpers, wherein a supporting body carrying the motor vehicle bumper consists of a blank formed in one piece from corrugated cardboard or solid board. An upper and a lower carrying band are interconnected at the ends thereof by means of a connecting web and a connecting tab respectively.

Packaging for motor vehicle bumpers is also known from JP 2007-050920 A, JP 2001-341737 A and JP 06-321231 A.

Moreover, DE 41 00 251 A1 discloses a highly complex collapsible box formed of a single cardboard blank, by which box the object is held in such a way that the use of foam for packing the goods can be dispensed with.

SUMMARY

An aspect of the invention provides a cardboard packaging configured to be produced by folding a single, flat cardboard blank for packing objects, the packaging comprising: a central portion; and two side portions, arranged on opposing sides of the central portion, wherein a respective outer surface of the side portions is arranged in a manner inclined towards the central portion so as to enclose an obtuse angle ($\alpha$) with respect to an adjacent outer surface of the central portion, wherein a respective outer surface of the side portions is configured to be connected to the central portion with a tuck-in flap connection, including a tuck-in flap and a perforation, wherein the outer surfaces of the side portions are respectively configured to be connected to the outer surface of the central portion by at least one tuck-in flap connection.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
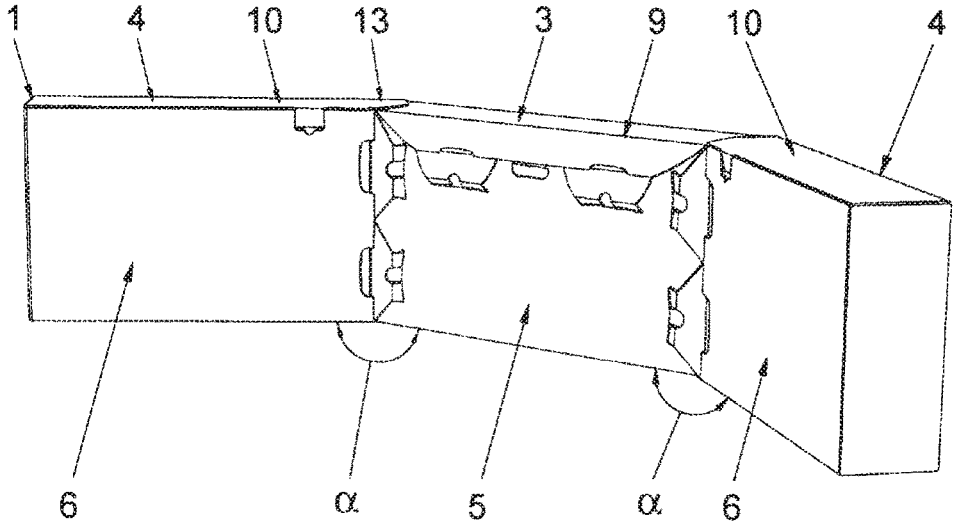
FIG. 1 is a perspective front view of cardboard packaging according to the invention.

An aspect of the invention provides a cardboard packaging produced by means of folding from a single, flat cardboard blank for packing objects in particular provided with bends or curves, comprising an in particular rectangular central portion and two in particular rectangular side portions which are arranged on opposing sides of the central portion, a respective outer surface of the side portions being arranged in a manner inclined towards the central portion so as to enclose an obtuse angle with respect to the adjacent outer surface of the central portion, and being connected to the central portion by means of a tuck-in flap connection consisting of a tuck-in flap and a perforation. A further aspect relates to a flat cardboard blank for producing cardboard packaging of this kind.

An aspect of the invention provides an option for configuring cardboard packaging, intended in particular for motor vehicle bumpers, which packaging is more loadable while also being easier to handle. A further object of the invention is that of providing a corresponding cardboard blank.

According to an aspect of the invention, cardboard packaging is therefore provided, in which the upper faces of the side portions are connected to the upper face of the central portion by at least one tuck-in flap connection respectively. As a result, the loading capacity of the cardboard packaging, in particular in the event of a force acting on the side portions, as often occurs during transport of the cardboard packaging, is significantly improved in a surprisingly simple manner. Specifically, the forces acting on the tuck-in flap connection when loaded are significantly reduced in that, unlike in the prior art in which the connection between the side portion and the central portion occurs on the front face and the rear face, the force transmission occurs according to the invention on an outer surface which in practice forms an upper face. In addition, according to the invention, loading of the tuck-in flap in a direction transverse to the main extension of the flap is dispensed with. Rather, in the case of the cardboard packaging according to the invention, force is introduced in a substantially even manner in the pulling direction of the tuck-in flap, which flap has its maximum loading capacity at this point. In addition, the arrangement is thus simultaneously such that there is a greater spacing from the fold lines, acting as a hinge axis, between the lower face of the central portion and the lower face of the side portion. A further advantage which is likewise particularly relevant in practice, consists in the fact that the invention can in principle be reliably connected using one tuck-in flap connection in each case between the respective side portion and the central portion, it of course also being possible for a plurality of tuck-in flap connections to be used, depending on the load to be expected and the dimensions of the cardboard packaging. In each case, said tuck-in flap connections are then in the same plane, meaning that the assembly can be constructed without problem by one person without additional means or additional people. As a result, the construction is simplified and the time required therefor is significantly reduced.

In the process, the loading capacity of the cardboard packaging can be further increased in a simple manner, in that the tuck-in flap connection is configured as a counter-tuck-in flap connection, in which the tuck-in flap comprises two bends which engage in parallel linear perforations. In addition, the tuck-in flaps are preferably oriented not only in parallel with one another, but rather one of the tuck-in flaps comprises a main plane engaging in the perforation, which main plane encloses an acute angle with the main direction of the pulling force, as a result of which the transmittable forces are further increased.

The allocation of the tuck-in flaps to the central portion and the side portion respectively stems in particular from the desire for a simple cardboard blank and the problem-free production thereof. Preferably, the tuck-in flaps are arranged on the side portions and inserted in each case in at least one perforation in the upper face of the central portion. The side portions may in each case have a basic shape of a prism, for example also an oblique prism, a parallelepiped or a truncated pyramid. In contrast, particularly appropriate in practice is a simple design of the cardboard packaging in which the front faces and the rear faces of the central portion and the side portions lie in the same plane and in which the side portions and the central portion are rectangular, in order to thus allow the cardboard packaging to be used as universally as possible.

In addition, it has already been found to be particularly useful for the side portions to have substantially matching dimensions, and for the respective angle between the outer surface of the central portion and the outer surfaces of the side portions to match, such that an overall symmetrical shape of the cardboard packaging is obtained. An object is thereby prevented from being packed in the cardboard packaging in such a way as to erroneously be wrongly oriented. At the same time, the logistical outlay is also reduced. Of course, an embodiment of the cardboard packaging according to the invention in which the side portions can optionally be set at different positions, each enclosing a specific angle, relative to the central portion in order to thus allow variable adjustment to different objects is not excluded thereby.

Although a configuration of the cardboard packaging in which the lower faces of the side portions and of the central portion lie in the same plane, which thereby form a continuous bottom contact surface of the cardboard packaging, is not excluded, it is in principle advantageous for the lower face of the central portion and the lower faces of the side portions to be arranged so as to follow a convex curve profile, such that the cardboard packaging is optimally adjusted to the contour of a curved product, in particular a product having one convex side and one concave side.

The configuration of the cardboard packaging according to the invention in addition makes it possible for the first time to produce the cardboard packaging purely by folding, creasing, insertion and the like, so that an adhesive joint, in particular adhesive strips or adhesive tape, can be dispensed with and the cardboard packaging can be used multiple times without restriction, and in the meantime can be returned to its flat blank form for this purpose.

A further embodiment which is particularly helpful for the construction of the cardboard packaging is also achieved in that at least one side portion is equipped with a plug-in connection by means of which a front face or a rear face is connected to an outer surface of the same side portion and a relative position can be set thereby. The side portion is thereby already brought into the desired shape and relative position in a simple manner before being connected to the central portion. Thus, in particular, after the side portion has been oriented relative to the central portion, the relative position thus reached is fixed solely by means of fixing the upper face to the front or rear face. The plug-in connection thus allows the position to be quickly set, which position is finally fixed by the tuck-in flap connection between the side portion and the central portion. The handling of the cardboard packaging is thereby further simplified for a single assembler, and the loading capacity is improved by the additional fixing points.

The further object of providing a cardboard blank for producing cardboard packaging is achieved in that the regions of the side portions and the central portion intended as the upper face are equipped with a tuck-in flap or a linear break or perforation for producing the tuck-in flap or perforation without using tools. The production of the cardboard packaging from the cardboard blank is significantly simplified thereby, since the tuck-in flaps are present on one side of the blank and the perforations are present on the other side in a logical arrangement, and the allocation thereof can be identified easily and without problem, even by a layman.

Figure 2:
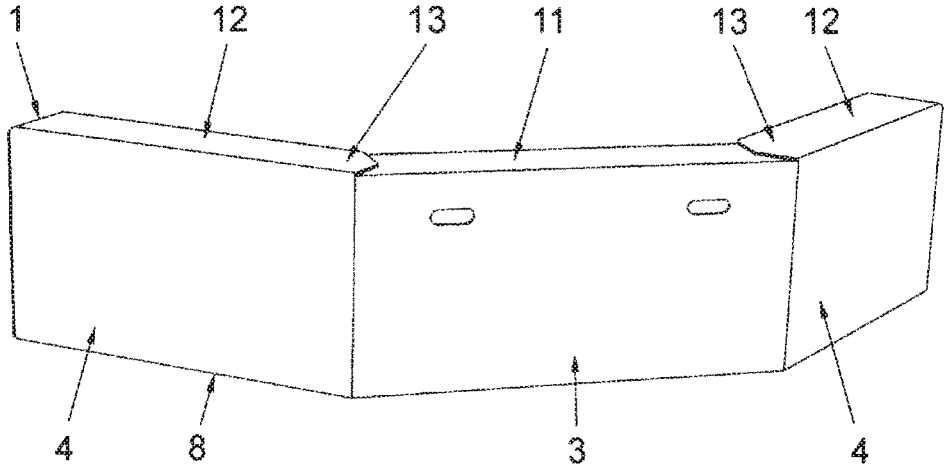
FIG. 2 is a rear view of the cardboard packaging shown in FIG. 1.
Figure 3:
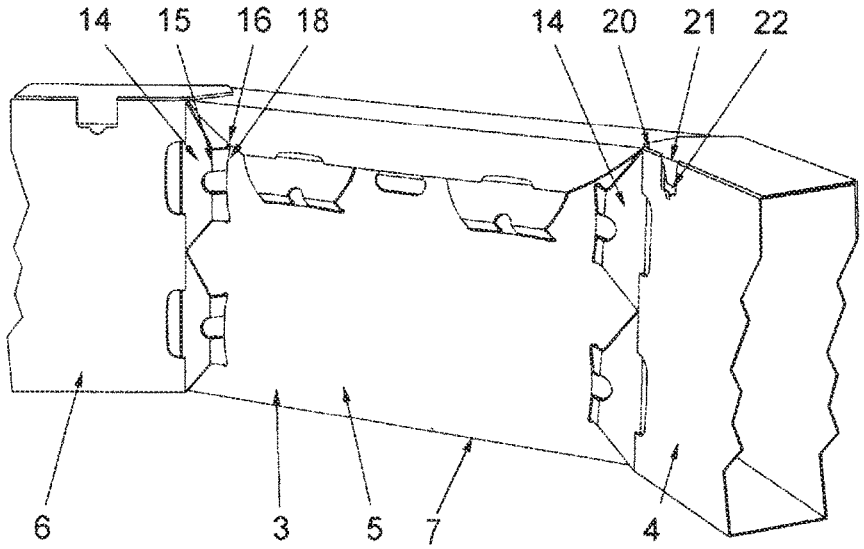
FIG. 3 is an enlarged detail of the cardboard packaging shown in FIGS. 1 and 2.
Figure 4:
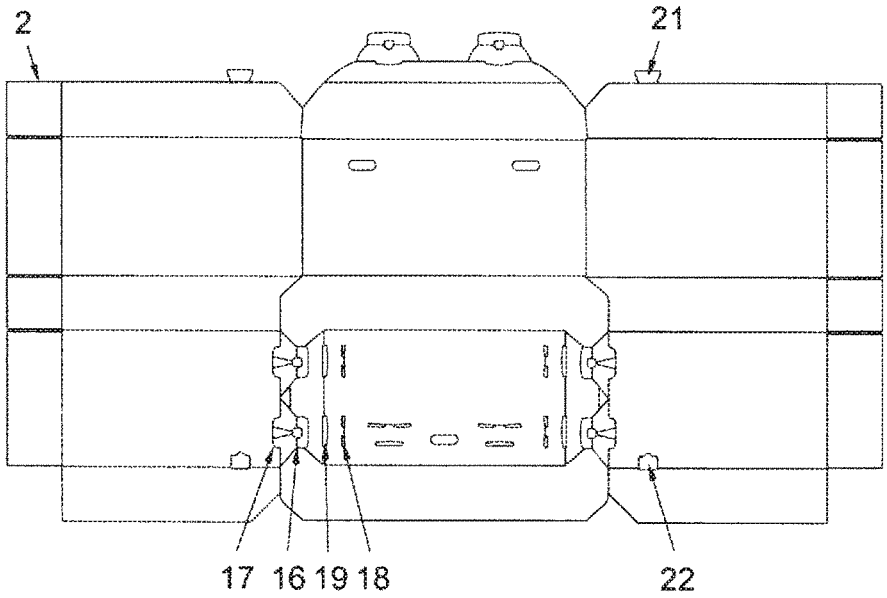
FIG. 4 shows a cardboard blank for producing the cardboard packaging shown in FIGS. 1 and 2.

Aspects of the invention will be described in more detail in the following, on the basis of the cardboard packaging 1 shown in FIGS. 1 to 3 and a cardboard blank 2, shown in FIG. 4, for the production thereof. The cardboard packaging 1 is produced from the flat cardboard blank 2 by means of simple manual folding and without the use of tools, and is used for packing elongate objects having bent ends (not shown), for example a bumper for a motor vehicle. For this purpose, the cardboard packaging 1 consists of a rectangular central portion 3 and two side portions 4 symmetrically arranged on opposing sides of the central portion 3, which side portions are arranged so as to be inclined at the same angle relative to said central portion. In particular, an outer surface 5 of the central portion 3 which forms the upper face thus encloses a predetermined obtuse angle $\alpha$ with said inclined outer surface 6 of the respective side portion 4, such that a concave upper face 7 and a convex lower face 8 of the cardboard packaging 1 results. In contrast, the front faces 9 of the side portions 4 and of the central portion 3, and the rear faces 11, 12 of the side portions 4 and of the central portion 3 each form parallel planes, overlap regions 13 resulting between the side portions 4 and the central portion 3. Unlike in the prior art, the fixing is not carried out in this overlap region 13. Rather, the surfaces 6 of the side portions 4 are each connected to the surface 5 of the central portion 3 by means of two tuck-in flap connections 14. Each of the tuck-in flap connections 14 designed as a counter-tuck-in flap connection has a tuck-in flap 15 having two bends 16, 17 which protrude in opposite directions and engage in parallel linear perforations 18, 19 in the central portion 3. A significant increase in the loading capacity of the cardboard packaging 1 is achieved by this bend 17, shown in FIG. 4, which is oriented counter to a main tensile force which typically occurs when the cardboard packaging 1 is loaded, in conjunction with an arrangement on the surfaces 5, 6. When constructing the cardboard packaging 1, however, firstly the relative position between the surface 6 and the front face 10 or rear face 12 respectively of the side portion 4 is fixed by means of a plug-in connection 20. For this purpose, a flap 21 of the plug-in connection 20 is pressed into a corresponding recess 22 in the side portion 4 as soon as the desired target position is achieved. The assembler can subsequently fix the tuck-in flap connections 14 without having to maintain or check the relative position between the side portion 4 and the central portion 3, with the result that the plug-in connection 20, as an additional means, has the function of rapidly ensuring the position and acting as an additional fixing point after the cardboard packaging 1 has been produced.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A packaging configured to be produced by folding a single, flat cardboard blank for packing objects, the packaging comprising:

a central portion including a central portion outer surface;

two side portions, arranged on opposing sides of the central portion, each of the two side portions including an outer surface inclined towards the central portion at an obtuse angle ($\alpha$) with respect to the central portion outer surface, and tuck-in flap connections, each of the tuck-in flap connections including a tuck-in flap and at least one perforation;

wherein the outer surface of each of the two side portions is configured to be connected to the central portion outer surface with at least one of the tuck-in flap connections.

2. The packaging of claim 1, wherein the tuck-in flap connections are configured as a counter-tuck-in flap connection with the at least one perforation including parallel linear perforations and the tuck-in flap including two bends which engage in the parallel linear perforations.

3. The packaging of claim 1, wherein each of the two side portions includes at least one said tuck-in flap arranged thereon that engages a corresponding said at least one perforation in the central portion outer surface.

4. The packaging of claim 1, wherein the central portion and the two side portions each include a front face and a rear face and one or both of the respective front faces and the respective rear faces lie in the same plane.

5. The packaging of claim 1, wherein the two side portions have substantially matching dimensions.

6. The packaging of claim 1, wherein the obtuse angle ($\alpha$) between the central portion outer surface and each respective said outer surface of the two side portions match.

7. The packaging of claim 1, wherein the central portion includes a central portion lower face and each of the two side portions includes a lower face, wherein the central portion lower face and each said lower face of the two side portions are arranged so as to follow a convex curve profile.

8. The packaging of claim 1, wherein the cardboard packaging is produced purely by at least one of folding, creasing, and insertion.

9. The packaging of claim 1, wherein at least one of the two side portions includes a plug-in connection and a front face and a rear face, wherein the plug-in connection connects one or both of the front face and the rear face to the outer surface of the at least one of the two side portions and a relative position is set thereby.

10. A flat cardboard blank for producing the packaging of claim 1.

11. The packaging of claim 1, wherein the central portion is rectangular.

12. The packaging of claim 1, wherein the two side portions are rectangular.

13. The packaging of claim 11, wherein the two side portions are rectangular.

14. An article, comprising:

the packaging of claim 1 including a motor vehicle bumper, disposed within the packaging.

* * * * *